US009283412B2

(12) United States Patent
Myer

(10) Patent No.: US 9,283,412 B2
(45) Date of Patent: Mar. 15, 2016

(54) FALL ARRESTING SYSTEM

(71) Applicant: 1827642 Alberta Ltd., Okotoks (CA)

(72) Inventor: Jerry Myer, Okotoks (CA)

( * ) Notice: Subject to any disclaimer, the term of this patent is extended or adjusted under 35 U.S.C. 154(b) by 0 days.

(21) Appl. No.: 14/331,488

(22) Filed: Jul. 15, 2014

(65) Prior Publication Data

US 2016/0016023 A1 Jan. 21, 2016

(51) Int. Cl.
*A62B 35/00* (2006.01)

(52) U.S. Cl.
CPC ..... *A62B 35/0093* (2013.01); *A62B 35/0037* (2013.01)

(58) Field of Classification Search
CPC ..... A62B 35/0037; A62B 35/0075; A62B 35/0093
USPC ..... 182/3, 231, 232
See application file for complete search history.

(56) References Cited

U.S. PATENT DOCUMENTS

| | | | | |
|---|---|---|---|---|
| 2,550,021 | A * | 4/1951 | Rappl | 49/167 |
| 3,794,079 | A * | 2/1974 | Fishel | 138/103 |
| 4,726,314 | A * | 2/1988 | Ayers | 114/243 |
| 5,789,701 | A * | 8/1998 | Wettengel et al. | 174/41 |
| 5,901,756 | A * | 5/1999 | Goodrich | 138/167 |
| 7,814,938 | B2 * | 10/2010 | Davis et al. | 138/106 |
| 8,292,245 | B2 * | 10/2012 | Schindler et al. | 248/237 |
| 8,752,590 | B2 * | 6/2014 | Petty et al. | 138/110 |
| 2005/0189170 | A1 * | 9/2005 | Pyrzewski | 182/3 |
| 2008/0135119 | A1 * | 6/2008 | Tonooka et al. | 138/110 |
| 2008/0283137 | A1 | 11/2008 | Davis, Jr. et al. | |
| 2010/0224448 | A1 | 9/2010 | Wolner et al. | |
| 2012/0118670 | A1 * | 5/2012 | Olson et al. | 182/232 |

* cited by examiner

*Primary Examiner* — Alvin Chin-Shue
*Assistant Examiner* — Kristine Florio
(74) *Attorney, Agent, or Firm* — Maxey Law Offices, PLLC; Stephen Lewellyn; Kyle Chapin

(57) ABSTRACT

A fall arresting system is provided that includes a fall arresting cable that has a safety line with opposed first and second ends, an accessory line that extends substantially along the safety line between the opposed first and second ends of the safety line, and a sheath that envelops the safety line and the accessory line. The fall arresting system further includes a reel upon which the fall arrest cable is wound.

9 Claims, 2 Drawing Sheets

FALL ARRESTING SYSTEM

FIELD OF THE INVENTION

The present invention relates generally to safety cables for preventing falls, and more particularly, relating to a fall arresting system having a retractable-cable reel and a safety line that has an integrated accessory line.

BACKGROUND OF THE INVENTION

Safety cables of various types for preventing a worker working at elevations from falling to the ground have been developed in the past. More specifically, safety cables heretofore devised and utilized consist of a myriad of designs that have been developed for the fulfillment of numerous objectives and requirements. While the devices heretofore fulfill their respective, particular objectives and requirements, they do not provide a fall arresting system that includes a retractable-cable reel (e.g., descent control device) and a safety cable having integrated therewith an accessory line as such there exists and need for a fall arresting system, which substantially departs from the prior art, and in doing so provides an apparatus primarily developed for the purpose of controlling descent and having an integrated safety cable and accessory line.

SUMMARY OF THE INVENTION

In view of the foregoing disadvantages inherent in the known types of safety cables now present in the prior art, the present invention provides a new fall arresting system wherein the same can be used for controlling descent and includes an integrated safety line and accessory line.

In accordance with the present invention, an apparatus for fall arresting is provided, that increases safety on a work site by always keeping the safety line tight and away from a worker's feet.

In accordance with the present invention, an apparatus for fall arresting is provided, that integrates a safety line and an accessory line, such as, an electrical power cable or a pneumatic hose, thereby reducing tripping hazards.

In accordance with the present invention, an apparatus for fall arresting is provided, that reduces the risk of tools falling from elevations by integrating a safety line and a tool accessory line together such that the accessory line safely tethers the tool against falling.

In general, in one aspect, a fall arresting system is provided. The fall arresting system includes a fall arresting cable that has a safety line with opposed first and second ends, an accessory line that extends substantially along the safety line between the opposed first and second ends of the safety line, and a sheath that envelops the safety line and the accessory line. The fall arresting system further includes a reel upon which the fall arrest cable is wound.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
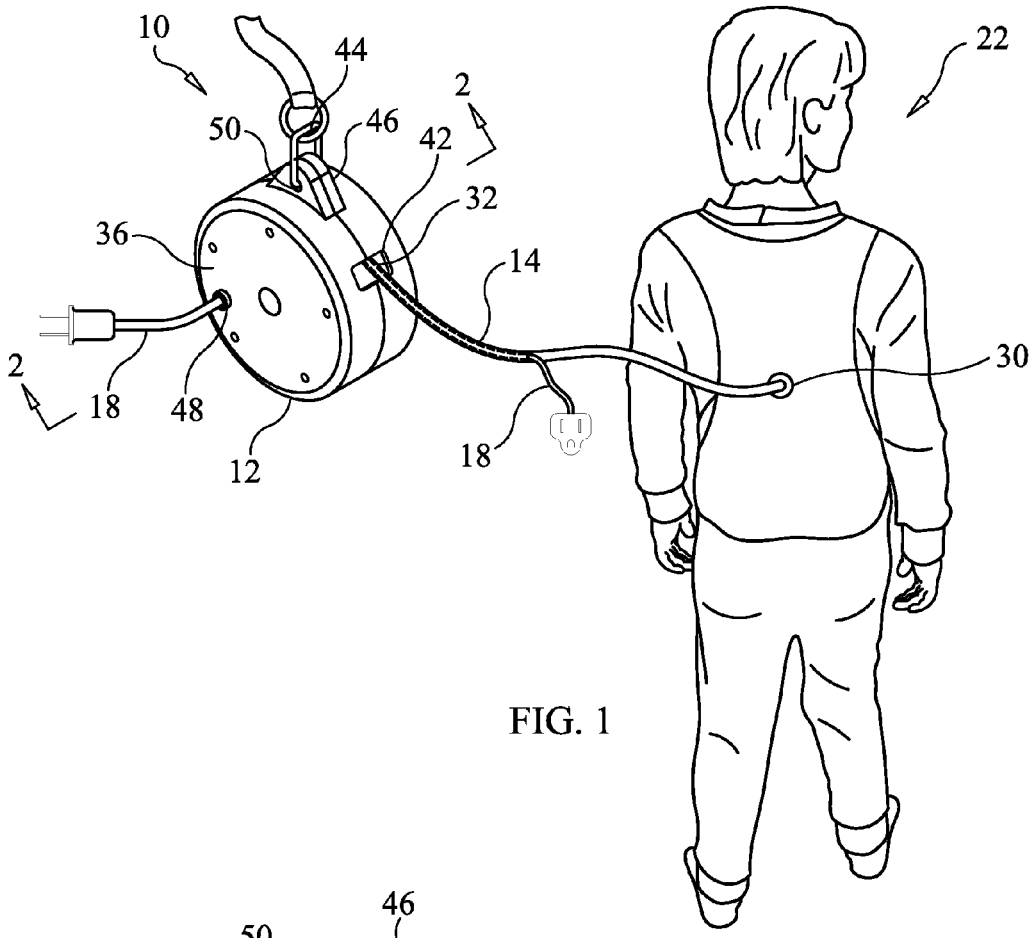
FIG. 1 is a diagrammatic, in-use view of a fall arresting system constructed in accordance with the principles of an embodiment of the present invention.

FIG. 1 representatively illustrates the fall arresting system 10 in use. The user 22 attaches the first end 30 of the fall arrest cable 14 to themselves. The fall arrest cable 14 extends away from the user 22 and attaches at the second end 32 to a retractable-cable reel 12. The fall arrest cable 14 includes an integrated accessory line 18 that allows the user 22 to use a pneumatic or electrical tool while attached to the fall arresting system 10 without implementing a trip hazard to the work environment.

Figure 2:
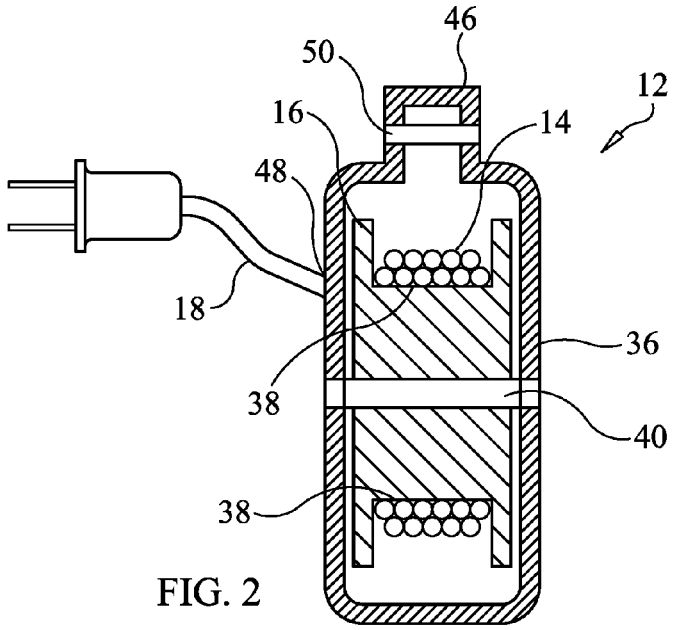
FIG. 2 is a diagrammatic, cross-sectional view of an exemplary retractable-cable reel of a fall arresting system constructed in accordance with the principles of an embodiment of the present invention.

FIG. 2 representatively illustrates a cross-sectional view of the exemplary retractable-cable reel 12. The retractable-cable reel 12 includes an exterior housing/casing 36 that envelopes a centrally mounted rotating spool 18 on which the fall arrest cable 14 wraps around. The accessory line 18 exits through a hole in the side of the retractable-cable reel 12 housing/casing 36.

Figure 3:
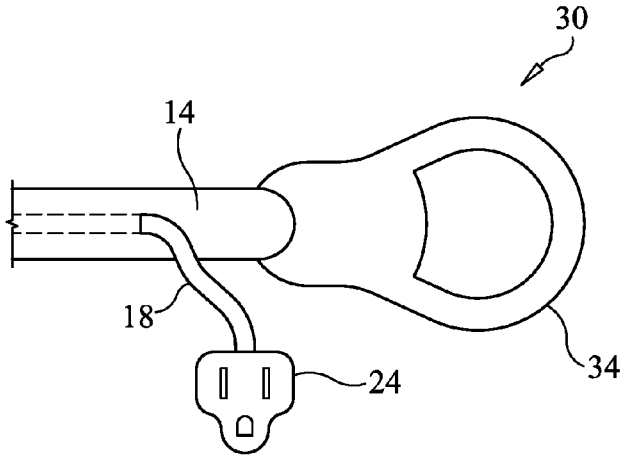
FIG. 3 is a diagrammatic view of an end of a safety cable of a fall arresting system constructed in accordance with the principles of an embodiment of the present invention.

FIG. 3 representatively illustrates one embodiment of the first end 30 of the fall arrest cable 14. The fall arrest cable 14 terminates and attaches to a ring 34 that has the ability to attach to the user. This embodiment demonstrates the fall arrest cable 14 incorporated with an electrical device connection 24 that exits the exterior sheath of the fall arrest cable 14 at some point before the ring 34.

Figure 4:
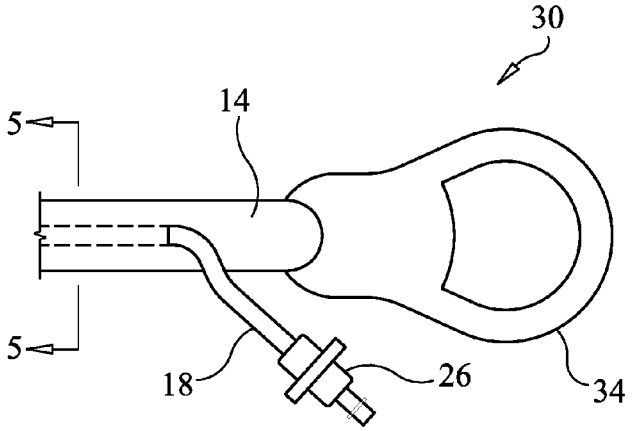
FIG. 4 is a diagrammatic view of an alternative end of a safety cable of a fall arresting system constructed in accordance with the principles of an embodiment of the present invention.

FIG. 4 representatively illustrates one embodiment of the first end 30 of the fall arrest cable 14. The fall arrest cable 14 terminates and attaches to a ring 34 that has the ability to attach to the user. This embodiment demonstrates the fall arrest cable 14 incorporated with pneumatic air powered device connection 26 that exits the exterior sheath of the fall arrest cable 14 at some point before the ring 34.

Figure 5:
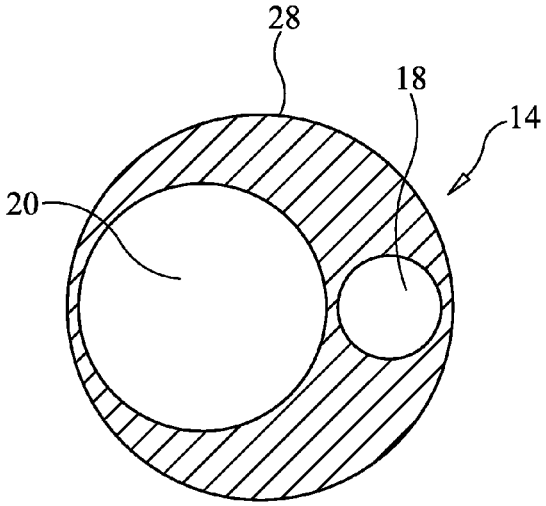
FIG. 5 is a diagrammatic, cross-sectional view of the safety cable taken along line 5-5 in FIG. 5.

FIG. 5 representatively illustrates a cross-sectional view of the interior of the fall arrest cable 14 having two parts enveloped by an exterior sheath 28. The accessory line 18 is positioned along-side the flexible cable 20 and both are wrapped together to make up one continuous cable for the substantial portion of the fall arrest cable 14.

Generally, the fall arresting system 10 includes a retractable-cable reel 12, and a fall arrest cable 14 that is wound onto the retractable-cable reel 12. The retractable-cable reel 12 can be any retractable-cable reel suitable for use with a fall arresting cable, safety line, etc. For example, U.S. Published Application No. 2010/022448, which is incorporated herein in its entirety by reference, describes a retractable-cord reel that could be employed with embodiments of the present invention. The invention, however, is not limited to use with this specific retractable reel design, because one of ordinary skill in the art would readily appreciate that other retractable-cable reels could be employed without departing from the scope of the invention.

The retractable-cable reel 12 includes a spool 16 mounted rotatably mounted on an axle 40 and a casing/housing 36 that encloses the spool 16. The fall arrest cable 14 wound on the spool 16 and extends through the cable outlet 42 away from the retractable-cable reel 12. The cable outlet 42 is located along the same axis as the spool's 16 motion, allowing the fall arrest cable 14 to proceed fluidly from the spool 16 to the attached individual located at the first end 30 of fall arrest cable 14.

The fall arresting cable 14 is generally an elongated cable like structure that has opposing first and second ends 30 and 32. The fall arresting cable 14 includes a length of flexible cable 22 that has a tensile strength capable of arresting an individual's fall, such as, a steel cable, for example. A cable coupling, such as carabineer or ring 34 is attached to the first end 30 of cable 22 and removably attaches or secures the first end 30 of cable 22 to a user 22.

The second end 32 of the fall arrest cable 14 attaches to the retractable-cable reel 12 at a point on the outside diameter portion 38 of the spool 16. The fall arrest cable 14 is wound on the spool 16, as shown in FIG. 2, allowing the fall arrest cable 14 to continuously retract and extend from the retractable-cable reel 12 as the user 22 moves with the fall arresting system 10 attached. The accessory line 18 extends through the housing/casing 36 at the accessory line exit 48, located alongside the housing/casing 36, allowing the user 22 to connect the accessory line 18 to an electrical outlet or an air compressor.

The fall arrest cable 14 further includes an accessory line 18 that extends substantially along the length of cable 22 between the first and second ends 30 and 32. An exterior sheath 28 tightly envelopes both the flexible cable 20 and the accessory line 18 from the first end 30 to the second end 32. The accessory line 18 exits the sheath 28 before the ring 34 attached to the first end 30. Depending on the model of fall arrest system 10, the accessory line 18 provides the user 22 attached to the fall arrest system 10, with either the ability to power an electrical tool using the electrical device connection 24 or the ability to power a pneumatic air tool using the pneumatic air powered device connection 26, FIG. 3 and FIG. 4.

Extending from the exterior of the housing/casing 36 is a casing attachment point 46. The casing attachment point 46 is the point where the reel hook 44 attaches to the retractable-cable reel 12. The reel hook 44 passes through the attachment hole 50 providing the user 22 with the ability to attach the retractable-cable reel 12 to a plurality of stationary points of safety. The stationary points of safety, preferably a building or like structure, is used to keep the retractable-cable reel 12 in a stationary position when the individual, attached to the first end 30 of the fall arrest cable 14, falls away from the retractable-cable reel 12.

With reference to FIGS. x through x, there is representatively illustrated a new xx 10 in accordance with an embodiment of the present invention.

A number of embodiments of the present invention have been described. Nevertheless, it will be understood that various modifications may be made without departing from the spirit and scope of the invention. Accordingly, other embodiments are within the scope of the following claims.

What is claimed is:

1. A fall arresting system comprising:

a fall arrest cable including:

a safety line having opposed first and second ends;

an accessory line having opposed first and second ends, said accessory line extending substantially along said safety line between said opposed first and second ends of said safety line;

a sheath enveloping said safety line and said accessory line;

a reel having a housing and a spool, said housing having a cable outlet and an accessory line exit formed through a side of said housing, and said fall arrest cable wound on said spool;

wherein said first end of said safety line and said first end of said accessory line extend through said cable outlet; and wherein said second end of said accessory line extends through said accessory line exit.

2. The fall arrest system of claim 1, wherein said accessory line is an electric power cable.

3. The fall arrest system of claim 1, wherein said accessory line is a pneumatic hose.

4. The fall arrest system of claim 1, wherein said reel is a retractable cable reel.

5. The fall arrest system of claim 1, wherein said sheath extends substantially between said first and said second ends of said safety line.

6. The fall arrest system of claim 1, wherein said first and second ends of said accessory line terminates exteriorly of said sheath.

7. A fall arresting system comprising:

a fall arrest cable including:

a safety line having opposed first and second ends;

an accessory line having opposed first and second ends, said accessory line extending substantially along said safety line between said opposed first and second ends of said safety line, said accessory line terminates exteriorly of a sheath;

said sheath enveloping said safety line and said accessory line substantially between said first and said second ends of said safety line;

a retractable cable reel having a housing and a spool, said housing having a cable outlet and an accessory line exit formed through a side of said housing, and said fall arrest cable wound on said spool;

wherein said first end of said safety line and said first end of said accessory line extend through said cable outlet; and wherein said second end of said accessory line extends through said accessory line exit.

8. The fall arrest system of claim 7, wherein said accessory line is an electric power cable.

9. The fall arrest system of claim 7, wherein said accessory line is a pneumatic hose.

* * * * *